United States Patent [19]

Morey

[11] 4,218,310

[45] Aug. 19, 1980

[54] PURIFICATION OF PARTICULATE GLASS BY MAG SEPARATION OF IMPURITIES

[75] Inventor: Booker W. Morey, Pasadena, Calif.

[73] Assignee: Occidental Petroleum Corporation, Los Angeles, Calif.

[21] Appl. No.: 829,439

[22] Filed: Aug. 31, 1977

[51] Int. Cl.[2] ..... B03C 1/26

[52] U.S. Cl. ..... 209/214; 209/3; 209/223 R

[58] Field of Search ..... 209/213–215, 209/2, 166, 3, 227, 223 R

[56] References Cited

U.S. PATENT DOCUMENTS

| | | | |
|---|---|---|---|
| 805,854 | 11/1905 | Medburg | 209/214 X |
| 994,871 | 6/1911 | Payne | 209/214 X |
| 1,071,838 | 9/1913 | Weatherby | 209/214 X |
| 1,999,825 | 4/1935 | Saklytwalla | 209/214 X |
| 2,065,460 | 12/1936 | Johnson | 209/214 |
| 2,094,440 | 9/1937 | Weis | 209/214 X |
| 2,975,897 | 3/1961 | Presgrave | 209/227 X |
| 3,045,821 | 7/1962 | Cavanagh | 209/227 X |
| 3,289,836 | 12/1966 | Weston | 209/214 |
| 3,877,578 | 4/1975 | Morey | 209/215 |

FOREIGN PATENT DOCUMENTS

| | | | |
|---|---|---|---|
| 964773 | 3/1975 | Canada | 209/166 |
| 289288 | 1/1915 | Fed. Rep. of Germany | 209/214 |

OTHER PUBLICATIONS

E and MJ, 165, No. 7, Neumann, Jul. 1964–pp. 88–91.

*Primary Examiner*—Robert Halper
*Attorney, Agent, or Firm*—Max Geldin; William N. Patrick; William G. Lane

[57] ABSTRACT

The present invention relates to the purification of glass, obtained by froth flotation from shredded municipal trash; more particularly, the present invention relates to a process for removing aluminum oxide, especially corundum, and silicon carbide particles or stones, of a size greater than 60 mesh, as impurities from the glass. The process comprises subjecting the froth-floated glass to magnetic separation, especially high intensity magnetic separation, such as that produced by employing a high intensity induced roll magnetic separator. Since such impurities function unexpectedly as magnetics in relation to glass, the refractory impurities are removed from the glass during such magnetic separation. The resulting purified glass can then be employed as glass cullet for production of finished glass articles.

14 Claims, 3 Drawing Figures

PURIFICATION OF PARTICULATE GLASS BY MAG SEPARATION OF IMPURITIES

BACKGROUND OF THE INVENTION

This invention relates to the purification of particulate glass obtained by froth flotation from municipal waste or trash, and is particularly concerned with procedure for removal of the deleterious refractory contaminants silicon carbide and aluminum oxide, particularly corundum, and especially as they appear in the form of relatively large size particles or stones, intermixed with froth-floated glass.

In the practice of recovering glass from shredded or incinerated municipal trash or waste by froth flotation, certain impurities are recovered with the glass. Iron as metals and oxide, often present in such recovered glass, has been removed heretofore by magnetic separation because it is an important color-causing impurity in glass. The U.S. Bureau of Mines, for example, has employed a high intensity wet magnetic separator on glass-containing incinerator residue for this purpose. Thus, the U.S. Bureau of Mines has employed a high intensity wet magnetic separator to remove weakly magnetic particles such as $Fe_2O_3$ or FeO, in conjunction with the floation method for glass recovery. Although such high intensity wet magnetic separation is effective in removing most of such iron or iron oxide impurities from the glass, it is ineffective in removing stones of refractory materials. Refractory particles or stones are particularly deleterious in the glass, since such impurities will not dissolve in the molten glass, and will subsequently form stones in the finished glass article produced from the froth floated glass. In contrast, the presence of a small amount of iron left in the glass does not seriously affect the quality of the glass product.

Corundum is the most frequently occuring refractory found in municipal trash, with silicon carbide nearly as common. As previously noted, the use of a high intensity wet magnetic separator has been found ineffective in removing such refractories or stones from froth floated glass or glass concentrate. Thus, bottles made using only 5% of such magnetically purified glass contained over 50 such stones in each pound of glass product. This is substantially in excess of the amounts of such impurities permitted in glass cullet. Thus, the specification for glass cullet with regard to the presence and number of such stones is particularly stringent with respect to the number of coarser stones of a size smaller than 20 mesh (Tyler) and larger than 40 mesh (−20+40 mesh), being not more than 50 millionths of 1% by weight, and the number of smaller stones of a size of 40 to 60 mesh (−40+60) being 5 ten thousandths of 1% by weight. It is therefore apparent that wet magnetic separation is not effective in reducing refractories to a sufficiently low level permitted according to the specification for purity of glass cullet, especially with respect to impurities such as silicon carbide and corundum stones.

In my copending application Ser. No. 795,531, filed May 10, 1977, there is disclosed a process for effectively removing silicon carbide and corundum from glass of relatively fine size produced by froth flotation of municipal trash, by electrostatic separation, particularly high tension electrostatic separation.

It is an object of the present invention to provide novel procedure for efficiently removing silicon carbide and/or aluminum oxide, particularly corundum, impurities from glass by a procedure different from that of my above application. Another object is the provision of novel procedure for separating such impurities in relatively large particle sizes in the form of stones greater than 40 mesh size, e.g. 20 to 40 mesh stones, as well as smaller 40 to 60 mesh size stones, from glass obtained by froth flotation. Yet another object is to provide a novel procedure to obtain a relatively high purity glass, e.g. in conformance with the specification for glass cullet, from froth flotation glass containing silicon carbide and corundum impurities.

DESCRIPTION OF THE INVENTION

It has been found unexpectedly according to the present invention that dry magnetic separation, particularly high intensity dry magnetic separation, and most particularly dry induced roll magnetic separation, can be employed for efficiently removing or substantially reducing refractory materials such as silicon carbide and aluminum oxide, particularly corundum, in glass, as contrasted to the above noted ineffective high intensity wet magnetic separation process for removing such refractory impurities from glass. In such dry magnetic separation, it has been found surprisingly that both silicon carbide and corundum which are not usually considered magnetically separable from poorly magnetic or non-magnetic substances such as glass, act as magnetic materials, so that silicon carbide and corundum, both heretofore considered as non-magnetics, are both present in the magnetic fractions and are thus separated from the non-magnetic glass particles. The process is particularly effective for removal of silicon carbide and/or aluminum oxide, particularly corundum, particles in the form of stones, from glass of relatively fine particle size produced by froth flotation of municipal trash or waste. Such magnetic separation procedure, particularly employing commercially available high intensity dry induced roll magnetic separators, can be effectively utilized for purifying recovered froth-floated glass to a degree approaching or exceeding the purity level for impurities such as silicon carbide and corundum required by the specification for glass cullet.

The use of such magnetic separator is effective according to the present invention for purifying glass recovered by froth flotation, for recovery of a product containing glass particles in a size range suitable for magnetic separation. Thus, high intensity dry induced roll magnetic separation employing high intensity magnetic separators, for example, the high intensity induced roll magnetic separators marketed by Carpco Research & Engineering, Inc., of Jacksonville, Florida, can effectively accommodate and separate glass or sand-like particles of from about 8 to about 250 mesh in size. The froth-floated glass product generally contains particles, including glass particles and also silicon carbide and corundum particles, of a size ranging from about 14 to about 400 mesh, usually about 20 to about 200 mesh, and hence such product is particularly applicable for separation of such silicon carbide and corundum impurities, by high intensity dry induced roll magnetic separation.

To applicant's knowledge there has been no information available to date with respect to the magnetic behavior of silicon carbide and aluminum oxide, particularly corundum, relating to their effective separation from glass. It is believed that silicon carbide and corundum especially exhibit a unique and unexpected behavior with regard to separation from glass by high intensity dry magnetic separation, since silicon carbide and corundum are reported to be diamagnetic. Thus, for example, in glass sand separation, chromite, iron oxides, mica, sericite, ilmenite and leucoxene are the refractories known to be magnetically removable by high intensity induced roll magnetic separation, whereas corundum and silicon carbide are not among them.

The process of the invention will be more readily understood from the description below of certain preferred embodiments, taken in connection with the accompanying drawings wherein.

Figure 1:
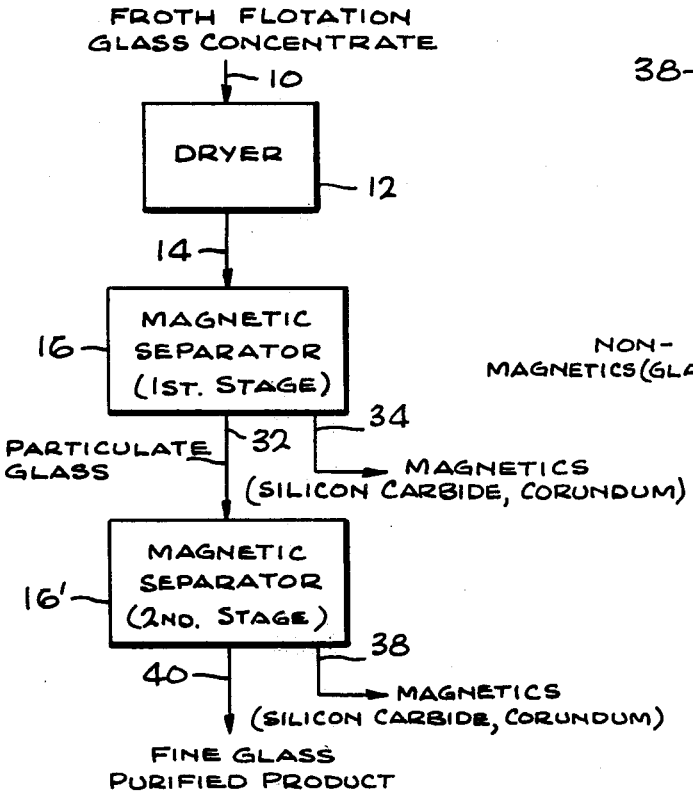
FIG. 1 is a schematic illustration of a preferred embodiment of the invention process.

Referring particularly to FIG. 1, illustrating two stages of magnetic separation according to the invention, a froth flotation glass concentrate 10 produced by froth flotation of shredded municipal trash containing glass, corundum and silicon carbide stones, is fed to a glass drier 12. After cooling, the discharge of the glass drier at 14 is fed to a first high intensity dry induced roll magnetic separator 16, according to the invention.

Figure 3:
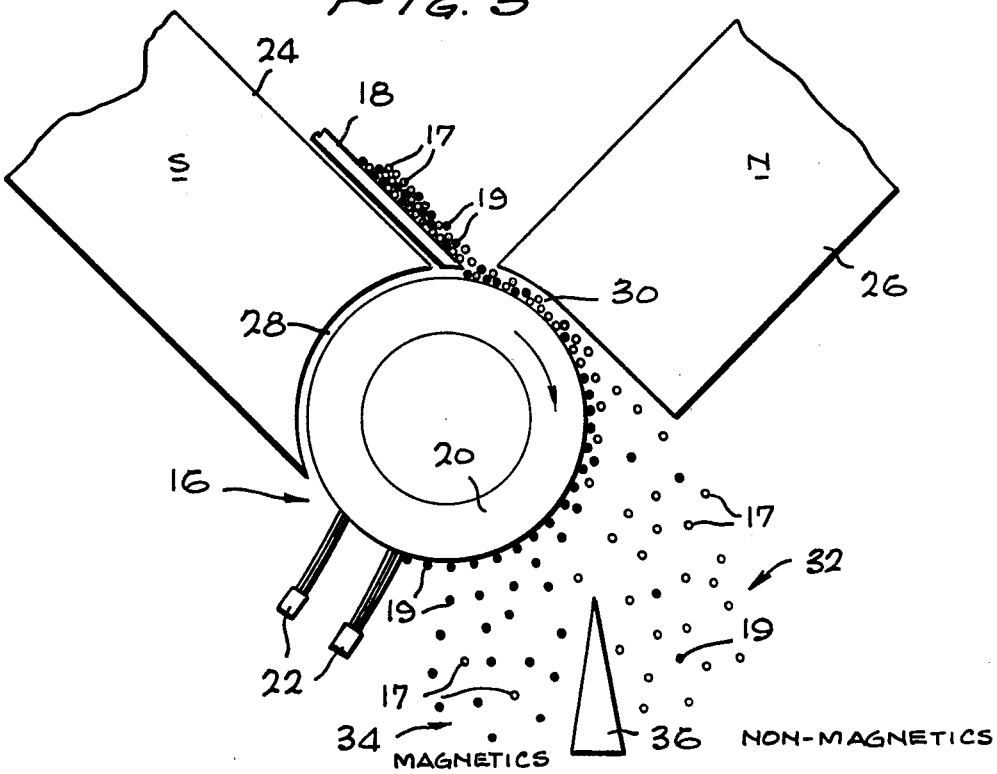
FIG. 3 illustrates a high intensity dry induced roll magnetic separator and the separation of impurities such as silicon carbide and corundum, functioning as magnetics, from glass, a non-magnetic material, utilizing such separator.

Referring to FIG. 3, the dried froth-floated glass concentrate 14, composed of a major portion of fine glass particles 17 and small amounts of particles of refractory materials 19, including silicon carbide impurities and corundum impurities, in the form of stones, some of a size greater than 40 mesh, e.g. 20 to 40 mesh, and some of particle size of 40 to 60 mesh, is fed from a vibrating tray feeder 18 onto the surface of a spinning rotor 20 mounted for rotation on suitable bearings (not shown), and driven by a suitable motor (not shown), Direct current is supplied to energize the field of the magnet comprising pole pieces 24 and 26, each disposed at an angle to the rotor 20, such pole pieces being adjustable by means (not shown), to move the pole pieces toward or away from the rotor to vary the gaps 28 and 30, between pole pieces 24 and 26, respectively, and rotor 20. The feed of froth flotation glass 14 on the surface of the spinning rotor 20, rotating in the high intensity induced magnetic field between pole pieces 24 and 26, causes the silicon carbide and corundum particles, indicated at 19, to function as magnetics and to be pinned to the rotor. Brushes 22 remove adhering particles from the rotor. The glass particles, indicated at 17, however, which are non-magnetic, are not attracted to the rotor.

Thus, the major portion of the non-magnetic glass particles 17 will not be attached to the rotor and will leave the rotor shortly after being placed thereon, as seen in FIG. 3, following a flight or path of movement away from the rotor to the right as seen in FIG. 3, to be discharged at 32, i.e. approximately the flight path which particles 17 would assume if there were no magnetic field at all. The major portion of the magnetic particles 19, consisting of silicon carbide and corundum particles, are held against the surface of the rotor during continued rotation of the rotor, and are removed by gravity, by brushes 22 as illustrated at the lower left in FIG. 3, or by some other suitable means. The magnetic particles are discharged at 34; a splitter 36 is provided to facilitate separation of the magnetics at 34, from the glass particles or non-magnetics at 32. However, in practice, a minor portion of the overall amount of glass particles 17 fed to the rotor 20 will also be removed with the magnetic fraction at 34. If desired, such glass particles so removed with the magnetics can be separated from the magnetics in a subsequent recleaning dry magnetic separation, and the so separated glass particles recycled for addition to the initial feed, as described in greater detail below.

The high intensity dry induced roll magnetic separator 16 incorporates various features for control of all of the variables which affect the separations including glass feed rate, variable rotor speed, gap adjustment between the pole pieces 24 and 26, and the rotor, field strength of the magnet, and angle of the splitter blade 36. For example, rotor speed can be varied from 0 to 500 RPM and the flux through the magnetic circuit can be increased by narrowing the gaps 28 and 30 between the rotor and pole pieces 24 and 26, respectively. The field strength of the magnet can be continuously varied from 0 to 16,000 gauss in the separating gaps 28 and 30, by controlling the voltage of the direct current supply, to vary the amount of current in the magnetic coil (not shown).

It will be understood that the high intensity dry induced roll magnetic separator 16 is a commercially available device which forms no part of the present invention.

According to one mode of operation, the first stage high intensity induced roll magnetic separator 16 can be operated so as to remove a portion of the magnetics, including silicon carbide and corundum stones and particles of varying size, together with some of the glass particles 17, as indicated at 34 in FIGS. 1 and 3. The partially purified particulate glass removed at 32 in FIGS. 1 and 3 can then be fed to a second stage magnetic separator 16' of the same type and construction as the first stage magnetic separator 16 illustrated in FIG. 3. The second stage high intensity dry magnetic separator 16' can be operated similarly to the first stage separator 16 so as to remove another portion of magnetics, including silicon carbide and corundum stones and particles of varying size, such magnetics so removed, indicated at 38 in FIG. 1 also including some glass particles 17.

The magnetics removed at 34 and 38 in both the first and second stage magnetic separators include a significant portion of the impurities or stones of a size greater than 40 mesh, and of a 40 to 60 mesh size. The glass product removed from the second stage magnetic separator, as indicated at 40 in FIG. 1, and comprising the major portion of the froth-floated glass concentrate fed to the first stage separator 16, has a substantially reduced amount of silicon carbide and corundum as compared to the initial glass concentrate feed, and can be of a purity with respect to silicon carbide and corundum stones for glass cullet used for producing finished glass articles such as containers.

Figure 2:
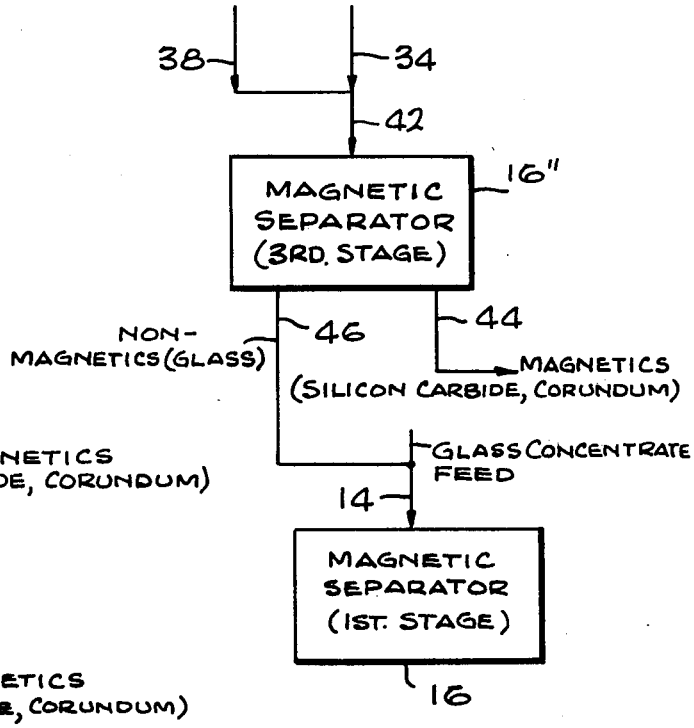
FIG. 2 is a schematic illustration of a modification of the process illustrated in FIG. 1.

Referring now to FIG. 2, the magnetics 34 and 38, and including fine glass particles separated in the first and second high intensity dry magnetic separator stages 16 and 16', can be combined at 42, and the resulting mix recleaned by feeding to a smaller third stage high intensity dry induced roll magnetic separator 16'', of a type and construction similar to the first and second stage magnetic separators 16 and 16'. Here the silicon carbide and corundum particles or magnetics are separated at 44, and the glass non-magnetics at 46 are recycled and mixed with the glass concentrate feed 14 which is fed to the first stage magnetic separator 16 in the process described above with respect to FIG. 1.

Although in preferred practice a two stage dry magnetic separation operation as described above in relation to FIG. 1 is employed, it will be understood that the process can be operated so that only one magnetic separator as illustrated at 16 in FIG. 3 can be utilized for adequate and effective removal of magnetics, particularly silicon carbide and corundum stones of relatively large size, to provide a fine glass product containing a substantially reduced amount of silicon carbide and aluminum oxide or corundum inpurities, from a froth flotation glass concentrate containing such impurities.

The following is an example of practice of the invention process:

A froth-floated glass cullet of 20 to 325 mesh (Tyler) produced by froth flotation of shredded municipal trash and containing silicon carbide and corundum stones as impurities was first dried and the dried glass concentrate was cooled.

The dried froth-floated glass concentrate was fed to a high intensity dry induced roll magnetic separator marketed by Carpco and of the type illustrated in FIG. 3 of the drawing.

The magnetic separator was operated employing one splitter, as shown at 36 in FIG. 3, so as to obtain two separate fractions, a magnetics fraction and a non-magnetics or glass product fraction as at 32 in FIG. 3.

The respective fractions were each screened to obtain two portions, one portion of particle size −20+40, and the other portion of particle size −40+60. In each of these portions the number or concentration of corundum and silicon carbide particles or stones per pound was determined.

Three separate tests were carried out as described above. In the third test, the particulate glass non-magnetic product produced by treatment on the magnetic separator was subjected to a second pass on the magnetic separator.

The data and results are set forth in the Table below:

TABLE

| | Concentration of Corundum and Silicon Carbide in Magnetic and Non-magnetic Fractions of Glass | | | | | |
|---|---|---|---|---|---|---|
| | | Corundum | | Silicon Carbide | | |
| | | −20+40 | −40+60 | −20+40 | −40+60 | Total |
| | Wt % | Stones/pound | | Stones/pound | | Stones/pound |
| Test 1 | | | | | | |
| Magnetics | 2.9 | 23 | 195 | 15 | 101 | 334 |
| Non-Magnetics | 97.1 | 4.5 | 23 | 0 | 14 | 41.5 |
| Test 2 | | | | | | |
| Magnetics | 3.6 | 50 | 215 | 0 | 132 | 397 |
| Non-Magnetics | 96.4 | 0 | 32 | 0 | 0 | 32 |
| Test 3 (First Pass) | | | | | | |
| Magnetics | 3.4 | 36 | 189 | 23 | 140 | 488 |
| Non-Magnetics | 96.6 | 4.5 | 23 | 0 | 45 | 72.5 |
| Test 3 (Second Pass) | | | | | | |
| Magnetics | 1.7 | 10 | 70 | 10 | 90 | 180 |
| Non-Magnetics | 98.3 | 0 | 32 | 0 | 23 | 55 |

The high concentration of corundum and silicon carbide stones in the magnetics fraction and the marked removal and relatively low concentration of such stones in the non-magnetics fraction, in each of the tests, is shown in the above table. It is noted that the much smaller magnetics fraction in each of the tests contains a substantially larger total amount of corundum and silicon carbide stones in each of the −20+40 and −40+60 portions, as compared to the total amount of corundum and silicon carbide stones in the respective −20+40 and −40+60 portions in the much larger non-magnetics fractions.

It is thus seen, for example, in Test 1, that in the magnetics fraction, constituting only 2.9% by weight of the total glass concentrate fed to the high intensity magnetic separator, there was concentrated a total of 334 corundum and silicon carbide stones, of a mesh size ranging from −20 to +60, per pound, as compared to a total of only 41.5 such stones of the same mesh size range, per pound, remaining in the non-magnetics glass fraction constituting 97.1% by weight of the initial feed.

The same substantial concentration of the corundum and silicon carbide stones, particularly the former, in the small magnetics fraction and reduction of such stones in the large non-magnetics fraction, is noted in Tests 2 and 3 in the table above.

The above results clearly show effective removal of corundum and silicon carbide as conductors from the non-conductive particulate glass.

From the foregoing, it is seen that the invention provides a unique, simple and inexpensive method for purifying particulate glass, especially a glass concentrate produced by froth flotation from shredded or incinerated municipal trash or waste, and containing impurities in the form of silicon carbide and/or aluminum oxide, especially corundum, particularly in the form of stones of a size greater than 60 mesh, particularly ranging from 20 to 60 mesh (−20+60), by subjecting the particulate glass containing such impurities to dry magnetic separation, especially high intensity dry induced roll magnetic separation, to remove all or a substantial portion of such impurities as magnetics, especially silicon carbide and/or corundum stones of the above noted mesh sizes. The terms "magnetic materials" and "magnetics" as employed herein are meant to denote materials other than glass, i.e. corundum and silicon carbide, responding as if having relatively good magnetic properties in relation to glass.

While I have described particular embodiments of my invention for purposes of illustration, it is understood that other modifications and variations will occur to those skilled in the art, and the invention accordingly is not to be taken as limited except by the scope of the appended claims.

What is claimed is:

1. A process for the separation of impurities selected from the group consisting of aluminum oxide and silicon carbide stones, and mixtures thereof, from a dried froth floated particulate glass concentrate, which comprises the steps of:

(a) subjecting said particulate glass concentrate containing a minor portion of said impurities by weight to high intensity dry induced roll magnetic separation, (b) separating the preponderant amount of said portion as magnetics from said particulate glass concentrate, and (c) recovering said particulate glass concentrate having a substantially reduced content of said impurities and suitable as a glass cullet.

2. A process as defined in claim 1, wherein said aluminum oxide is corundum.

3. A process as defined in claim 2, wherein said impurities are a mixture of corundum and silicon carbide stones.

4. A process as defined in claim 2, wherein said particulate glass concentrate is obtained by froth flotation from shredded municipal waste containing glass and said impurities.

5. A process as defined in claim 2, wherein the particles of said glass concentrate have a size ranging from about 14 to about 400 mesh.

6. A process as defined in claim 2, wherein the glass concentrate particles of said particulate glass have a size ranging from about 14 to about 400 mesh, and said separated impurities include particles of a size greater than 60 mesh.

7. A process for the purification of a dried particulate glass concentrate containing glass particles and impurities selected from the group consisting of silicon carbide and corundum stones, and mixtures thereof, the glass particles of said glass concentrate having a size ranging from about 14 to about 400 mesh, said impurities representing a minor portion of said concentrate by weight, and including stones having a size greater than 60 mesh, which comprises the steps of:

(a) subjecting said glass concentrate to high intensity dry induced roll magnetic separation, (b) removing the preponderant amount of said portion as magnetics from said particulate glass, and (c) recovering said particulate glass concentrate having a substantially reduced content of said impurities, as non-magnetics and suitable as a glass cullet.

8. A process as defined in claim 7, wherein said impurities are a mixture of corundum and silicon carbide.

9. A process as defined in claim 7, wherein said stones have a size of 20 to 60 mesh.

10. A process as defined in claim 9, said impurities being a mixture of silicon carbide and corundum stones.

11. A process as defined in claim 10, wherein the glass particles of said particulate glass concentrate have a size ranging from about 20 to about 200 mesh.

12. A process as defined in claim 7, said magnetic separation being carried out by feeding said particulate glass concentrate to the spinning rotor of a high intensity dry induced roll magnetic separator mounted between gapped pole pieces, said preponderant portion of said impurities being magnetically attracted and pinned to said rotor while said glass particles together with a minor portion of said impurities fall away from said rotor.

13. A process as defined in claim 12, the field strength of said induced roll magnetic separator ranging up to 16,000 gauss in the operating gaps.

14. A process as defined in claim 7, including (d) subjecting said recovered particulate glass concentrate of substantially reduced impurities content to a second high intensity dry induced roll magnetic separation.

(e) removing an additional portion of said impurities as magnetics from said recovered particulate glass concentrate, and (f) recovering a particulate glass product having a further reduced content of said impurities.

* * * * *

UNITED STATES PATENT AND TRADEMARK OFFICE

CERTIFICATE OF CORRECTION

PATENT NO. : 4,218,310

DATED : August 19, 1980

INVENTOR(S) : Booker W. Morey

It is certified that error appears in the above-identified patent and that said Letters Patent are hereby corrected as shown below:

TITLE OF INVENTION, "PURIFICATION OF PARTICULATE GLASS BY MAG SEPARATION OF IMPURITIES" should be --PURIFICATION OF PARTICULATE GLASS--.

Column 6, lines 20, 21 and 22 should be deleted in their entirety.

Signed and Sealed this

*Fourteenth* Day of *April 1981*

[SEAL]

*Attest:*

RENE D. TEGTMEYER

*Attesting Officer*

*Acting Commissioner of Patents and Trademarks*